United States Patent [19]

DiMartino

[11] Patent Number: 4,846,140

[45] Date of Patent: Jul. 11, 1989

[54] SPIKE STAND FOR COMPOUND ARCHERY BOWS

[76] Inventor: Paul J. DiMartino, 4836 Dudley, Dearborn Heights, Mich. 48125

[21] Appl. No.: 58,274

[22] Filed: Jun. 4, 1987

[51] Int. Cl.[4] ..... A47G 29/00; A45F 3/44; F41B 5/00

[52] U.S. Cl. ..... 248/360; 248/156; 124/86

[58] Field of Search ..... 124/23 R, 29 R, 86, 124/88, 89; 248/533, 532, 530, 156, 360, 359 C, 359 F

[56] References Cited

U.S. PATENT DOCUMENTS

| | | | |
|---|---|---|---|
| 2,275,870 | 3/1942 | Sheldon | 124/23 R |
| 2,502,684 | 4/1950 | Ward | 248/532 |
| 2,926,874 | 3/1960 | Hahn | 248/533 |
| 3,167,062 | 1/1965 | Zwickey | 124/23 R |
| 3,286,961 | 11/1966 | Mandolare | 124/24 R |
| 3,584,820 | 6/1971 | Butcher | 124/24 R |
| 4,628,893 | 12/1986 | Shaw | 124/23 R |

*Primary Examiner*—Richard C. Pinkham
*Assistant Examiner*—Benjamin Layno
*Attorney, Agent, or Firm*—Richard C. Litman

[57] ABSTRACT

A stand for supporting a compound archery bow includes a spike member having a pointed end adapted to be driven into the ground and an opposite end connected to a swivellable bracket member attached to the lower limb of the bow by a releaseable clamp. The bracket has a special nut with a handle for securing the spike member in its ground-engaging position, or alternatively into a position suitable for carrying or storing the bow.

10 Claims, 2 Drawing Sheets

SPIKE STAND FOR COMPOUND ARCHERY BOWS

BACKGROUND OF THE INVENTION

Compound archery bows utilize pulleys, eccentric cams, and complex string arrangements to provide desired operating characteristics. Compound bows are complex in construction, expensive to manufacture, often relatively heavy, and of bulky geometry. Stands or supports for archery bows are known, and devices wherein the bow is supported upon a stand are utilized with bows to aid in stringing them.

However, since devices are not readily usable with compound bows, and the presence of pulleys and eccentric cams prevents the bow holder stands from being utilized with compound bows. The present invention relates to a spike stand suitable for supporting a compound bow in waiting or resting periods of the archer and during operation of the bow.

This bow stand, which is of particularly simple design and therefore easy to fabricate and manufacture, has the following further advantageous features: it can be clamped to the bow at a position that provides the most stable support of the bow, near the middle of the lower limb of the bow; and once clamped in place, the spike member of the invention can be swivelled between two securable positions, in the first of which the pointed end of said spike member engages the ground, and in the second of which, of 180-degree orientation with respect to the first position, the spike member is unobtrusively angled so that when the spike member is so swiveled, the combination of bow and stand is conveniently portable and storable.

DESCRIPTION OF THE PRIOR ART

The following U.S. patents disclose inventions which relate to the field of the present invention.

| U.S. Pat. No. | Inventor |
|---|---|
| 1,851,779 | Slater |
| 3,256,872 | Koser |
| 3,991,780 | Maroski, Jr. |
| 4,331,311 | Russell |

The patent to Koser (3,256,872) comprises a tripod stand for an archery bow. Because the tripod stand rests on the surface of the ground, it is unstable or not level on hilly terrain. Furthermore, an attached arrow quiver sometimes used by archers can cause a weight distribution problem. The tripod stand is much more easily blown over by a hard gust of wind than the spike stand. Consequently, such a tripod stand is more suited for supporting archery bows between periods of use in protected or indoor locations.

The Slater U.S. Pat. No. (1,851,779) consists of a spike that engages the ground, a bow holder that supports the bow horizontally, and an annular arrow holder that holds arrows vertically. This spike stand is collapsible and intended to be stored during actual operation of the bow.

The Maroski, Jr. U.S. Pat. No. (3,991,780), is a combination archery bow stand, walking cane, and animal dragging device. The stand portion of the device consists of a straight spike with two projections. On the upper projection, the bow is hung by its upper limb. The lower projection is an L-shaped bracket to which the lower limb of the bow is engaged. This device is not designed for use with a compound bow and would also add considerably to the total weight that has to be carried by the archer.

SUMMARY OF THE INVENTION

An object of this invention is to provide a spike stand for supporting a compound archery bow during the operating, waiting, or resting periods of the archer. The spike member, preferably made of aluminum, is long and strong enough that, when inserted to an adequate depth in the ground at its pointed end to support the bow at the required height for maximum ease and comfort of the archer, the bow is still held well above the ground by the stand so that, for example, a pulley at the bottom of the bow limb, often found in modern bow designs, will not contact the ground. Should the bow limb contact the ground, mud, sticks, snow, leaves, or other debris can cause the pulley to jam. In ordinary ground, the spike stand supports the bow stably enough so that a wind cannot blow the bow over. The distance of the bow above ground can be easily increased or decreased since the spike stand is easily pulled out or pushed in the ground, respectively.

The invention includes an angle bracket with a first side that is rigidly connected to the nonpointed end of the spike member and a second side that is bolted to the diagonally oriented wall of a channel of rectangular cross section in the front plate of a bolted clamp that engages the lower limb of the bow. A special hand-tightenable nut for the angle bracket, when loosened, allows the bracket to swivel into two securable positions, one for supporting the bow during use, and the other for having the spike member out of the way during storage or transport. The device is secured in the two alternate positions by hand-tightening the nut.

The invention further includes a wrapping of felt, leather, or a similar resilient, durable material to be wrapped entirely around the bow limb at the place of attachment of, and between, the bow limb and clamp to protect the bow limb from scratching or from other damage due to the clamp.

In one preferred embodiment, the spike member is bent into two straight portions at an obtuse angle, such that, during ordinary use of the invention, the first straight portion is essentially tangential to the arc of the bow in the vicinity of the clamp of the invention, and the second straight portion is essentially vertical with respect to the ground. In an alternate configuration, the spike member is entirely straight, and the orientation of the angle bracket is changed so that both the bowstrings and spike member of the invention are oriented essentially vertically during use of the invention.

BRIEF DESCRIPTION OF THE INVENTION

Referring now to the drawings.

DESCRIPTION OF THE PREFERRED EMBODIMENT

Figure 1:
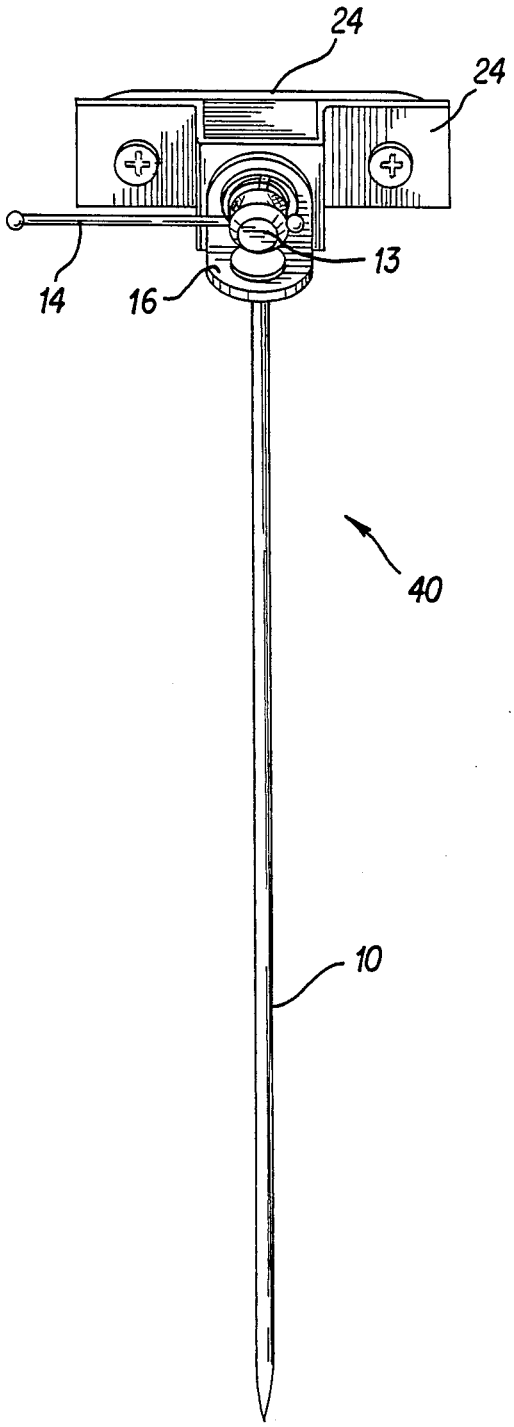
FIG. 1 is a front view of the stand and its attaching hardware, in which the spike is bent.
Figure 2:
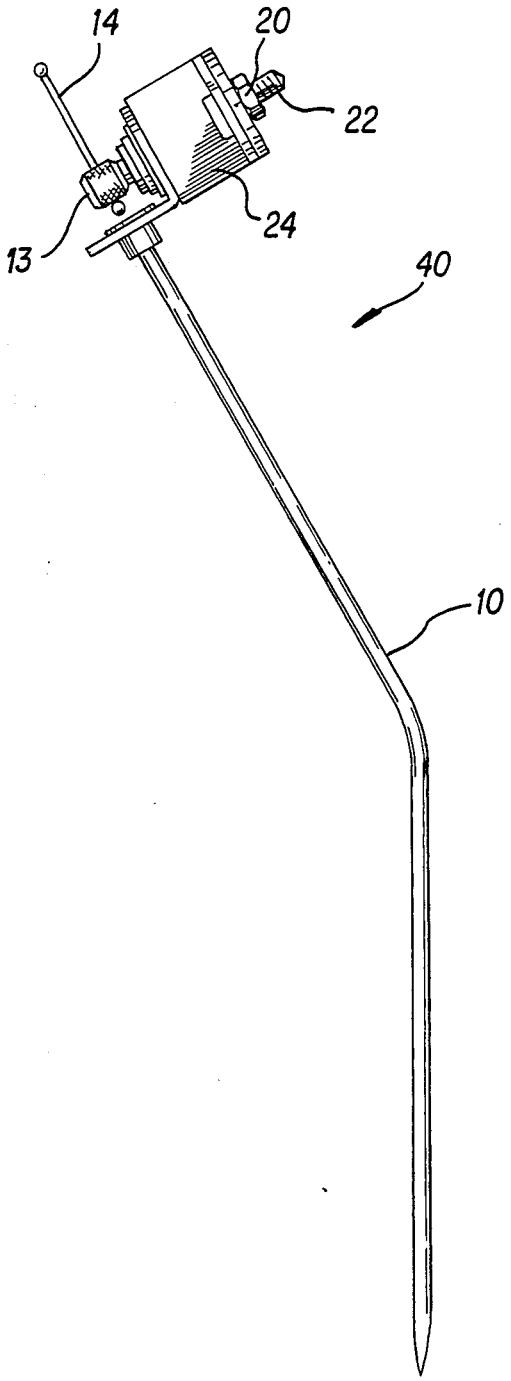
FIG. 2 is a side view of the bent-spike stand and its attaching hardware.
Figure 3:
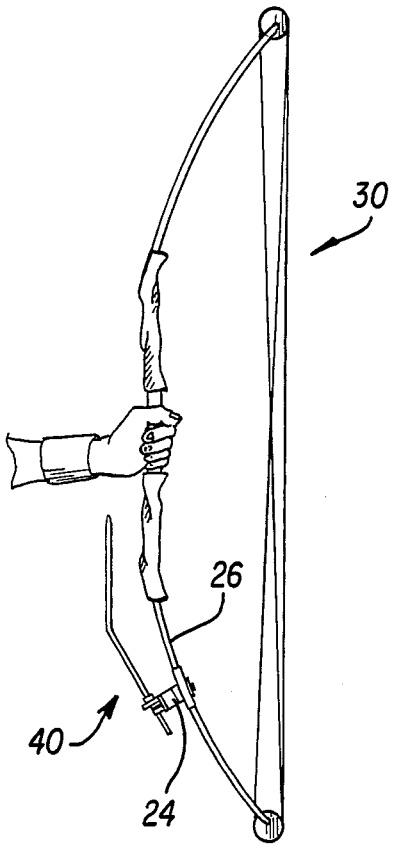
FIG. 3 is a side view of the bent-spike stand clamped to a bow limb in the carrying position.
Figure 4:
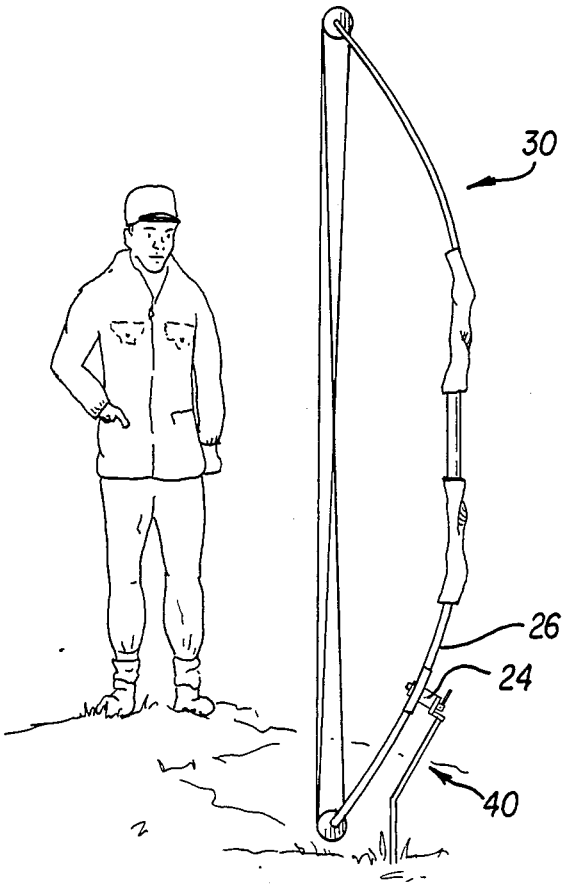
FIG. 4 is a side view of the bow ready for operation with the bent-spike stand engaging the ground.

Referring now to the drawings, particularly FIGS. 3–4, the present invention will be seen to relate to a spike stand generally designated 40, adapted to be removably attached to the medial portion of the lower limb 26 of an archery bow such as the compound bow 30. The stand includes a spike member 10 having a first section 10*a* attached going to a second section 10*b* at an obtuse angle and terminating in a pointed tip 10*c*. In the use position of FIG. 4, the spike member will be seen to be disposed downwardly with its first section 10*a* substantially parallel to the lower limb 26 while the second section 10*b* is disposed in a vertical plane and driven into the ground so as to support the bow 30 in an elevated manner above the ground whereby the bow is protected from any underbrush and is readily available for instant use or alternatively, any required maintenance of the bow.

Figure 5:
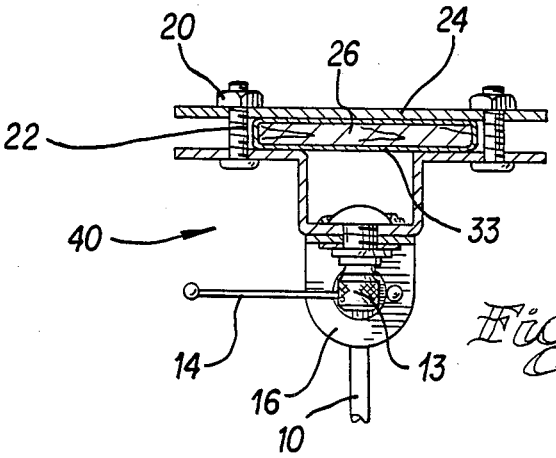
FIG. 5 is a horizontal cross section of the clamp assembly of the bent-spike stand.

Ready means are provided for the quick attachment and removal of the spike stand 40 from the bow limb 26 in view of a clamp assembly 24 including a cooperating belly plate 25 and backplate 27. As will be seen most clearly in FIG. 5 of the drawings, the planar belly plate 25 is adapted to overlie the belly of the bow lower limb 26 while the plate 27 is juxtaposed the limb back. The clamp assembly is affixed at a medial location upon the lower limb by suitable removal fasteners such as the nuts 20 and bolts 22 while a protective layer 33 of cushion material is wrapped about the limb intermediate the two plates 25, 27.

The backplate 27 includes a pair of outer flanges 28–28 extending outwardly from a medial channel 29. The channel will be seen to include an offset wall 29*a* spaced from and paralell to the surface of the bow limb and will serve as mounting means for a displaceable angle bracket 16. This bracket includes a substantially horizontally wall 16a joined perpendicularly to a substantially vertical wall 16b the latter of which is juxtaposed the channel offset wall 29*a*. The free end of the spike member first section 10*a* is fixedly secured by any suitable means to the angle bracket horizontal wall 16*a* while appropriate releasable locking means are provided to secure the angle bracket vertical wall 16*b* to the juxtaposed channel 29. This locking means preferably comprises a lock bolt 31 secured to the channel offset wall 29*a* and having a threaded shank 31*a* extending therethrough as well as through a free opening in the angle bracket vertical wall 16*b*. Engageable with the free end of the threaded shank 31*a* is a releasable lock fastener nut member 13 which will be seen to be provided with a slidable manipulating member in the form of the handle 14.

With the foregoing structure in mind it will be seen that upon manipulation of the handle 14, the lock fastener member 13 may be alternatively loosened or tightened to permit displacement of the bracket member 16 and its attached spike member 10 to allow shifting of the latter between the storage position of FIG. 3 of the drawing to the use position of FIG. 4.

With the present construction it will be appreciated that ready means are provided allowing support of the archery bow in a vertical position with its lower most structure above the ground such that the entire bow is positioned in a protective manner free of underbrush yet during transport or use of the bow the displaceable spike member 10 is quickly and easily shifted to an alternate, use position that will not impede the archers manipulation of the bow. Various well known accessories may still be utilized in combination with the current invention, such as bow quivers and sights without interference therewith.

Figure 6:
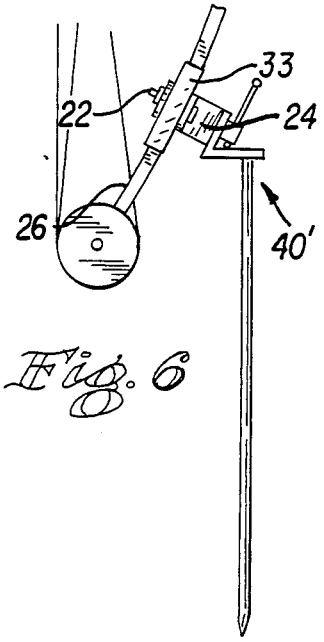
FIG. 6 is a partial side view of an alternative structure.

Additionally, the simplicity of the clamp assembly 24 allows ready shifting of the attachment point of the spike stand upon a bow lower limb 26 so that the vertical spike member second section 10*b* is disposed substantially along the center of gravity of the strung bow such as viewed in FIG. 4 of the drawings thereby providing a balanced combination. The arrangement of FIG. 6 depicts an alternative construction wherein the clamp assembly 24' is attached at a lower point adjacent the tip of the limb 26 and includes an angle bracket 16' wherein the two walls thereof define an acute angle. With this embodiment the spike member 10' comprises a single straight section. In view of the parallel disposition of the bracket wall 16c relative to the limb face, the vertical spike shown in FIG. 6 will be understood to change to an angular disposition, parallel to the limb 26, when pivoted to the storage position.

I claim:

1. A stand for supporting a compound archery bow having upper and lower limbs each provided with a belly and back comprising:

a clamp assembly having fastening means permitting removable fixed attachment of the stand about the periphery of the lower limb of an archery bow, bracket means adjacent said clamp assembly, swivel means connecting said bracket means to said clamp assembly to allow rotation of said bracket means about an axis substantially perpendicular to the plane of a bow lower limb, and a spike member attached to said bracket means and displaceable with said bracket means from a storage position with said spike member extending upwardly in a bow use position to a holding position whereby said spike member is directed downwardly for engagement with the ground, whereby said stand may remain attached to a bow throughout its use with said spike member displaced to alternate positions, said spike member being further characterized by including a first section joined to said bracket means and an attached second section angularly offset from said first section.

2. A stand according to claim 1 wherein, said clamp assembly is attachable substantially at the medial point of a bow lower limb.

3. A stand according to claim 1 wherein, said angularly offset spike member sections define an obtuse angle there between.

4. A stand according to claim 3 wherein, said spike member first section is adapted to be disposed substantially parallel to a lower bow limb and said second section is adapted to be disposed in a plane parallel to the vertical extent of a bow.

5. A stand according to claim 4 wherein, said spike member comprises a substantially straight section and said lower assembly is attachable adjacent an end of a bow lower limb.

6. A stand according to claim 1 wherein, said spike member second section terminates in a pointed end.

7. A stand according to claim 1 wherein, said clamp assembly includes a belly plate attachable adjacent the belly of a bow lower limb and a back plate attachable adjacent the back of a bow lower limb.

8. A stand according to claim 7 including, a protective member contacting said clamp assembly belly and back plates and engageable with a bow lower limb belly and back.

9. A stand according to claim 1 wherein, said bracket means includes a pair of walls normal to one another, one said wall juxtaposed said clamp assembly and the other said wall supporting said spike member.

10. A stand according to claim 9 wherein, said swivel means includes hand releasable lock means.

* * * * *